US009144280B1

(12) United States Patent
Jacks

(10) Patent No.: US 9,144,280 B1
(45) Date of Patent: Sep. 29, 2015

(54) SYSTEMS, DEVICES, AND METHODS FOR ENCLOSING, TRANSPORTING, AND/OR STORING ART PIECES

(71) Applicant: Esther E. Jacks, Norwalk, CA (US)

(72) Inventor: Esther E. Jacks, Norwalk, CA (US)

( * ) Notice: Subject to any disclaimer, the term of this patent is extended or adjusted under 35 U.S.C. 154(b) by 0 days.

(21) Appl. No.: 14/610,133

(22) Filed: Jan. 30, 2015

(51) Int. Cl.
*B65D 5/10* (2006.01)
*A45C 11/00* (2006.01)

(52) U.S. Cl.
CPC ..... *A45C 11/00* (2013.01)

(58) Field of Classification Search
CPC ..... B65D 5/2038; B65D 5/2057
USPC ..... 206/449, 1.7; 229/87.02, 148, 158
See application file for complete search history.

(56) References Cited

U.S. PATENT DOCUMENTS

| | | | | | |
|---|---|---|---|---|---|
| 1,763,072 | A | * | 6/1930 | Smith | 229/117.14 |
| 1,983,010 | A | * | 12/1934 | Spees | 229/117.15 |
| 2,008,443 | A | * | 7/1935 | Froehlig | 229/117.14 |
| 2,976,985 | A | | 8/1960 | Kraus | |
| 2,990,993 | A | * | 7/1961 | Buttery | 229/108 |
| 3,027,063 | A | * | 3/1962 | Zastrow | 229/155 |
| 3,403,839 | A | * | 10/1968 | Farquhar | 229/112 |
| 4,318,505 | A | * | 3/1982 | Cordell, Jr. | 190/115 |
| 4,471,869 | A | | 9/1984 | Hasenfus | |
| 4,493,504 | A | | 1/1985 | MacHose | |
| 4,881,771 | A | | 11/1989 | Sullivan | |
| 5,169,058 | A | * | 12/1992 | Sample | 229/117.23 |
| 5,364,021 | A | * | 11/1994 | Munk | 229/157 |
| 5,522,538 | A | * | 6/1996 | Gray | 229/112 |
| 6,116,421 | A | * | 9/2000 | Collins | 206/455 |
| 7,044,305 | B2 | * | 5/2006 | Girondi et al. | 206/778 |
| 8,087,633 | B2 | | 1/2012 | Vargo | |
| 2004/0232025 | A1 | | 11/2004 | Lunde | |
| 2006/0186186 | A1 | * | 8/2006 | Kuhn et al. | 229/143 |

OTHER PUBLICATIONS

Judsons Art Outfitters, Plein Air Porter, Product Information Available at http://www.judsonsart.com/pleinair/pc/Plein-Air-Porter-52p920.htm, Mar. 13, 2015.

Judsons Art Outfitters, Guerrilla Painter Wet Painting Tote, Product Information Available at http://www.judsonsart.com/pleinair/pc/Guerrilla-Painter-Wet-Painting-Tote-52p1433.htm, Mar. 13, 2015.

Jusdson Art Outfitters, Guerrilla Painter Adjustable Wet Paint Carrier, Product Information Available at http://www.judsonsart.com/pleinair/pc/Guerrilla-Painter-Adjustable-Wet-Painting-Carriers-52p57.htm, Mar. 13, 2015.

(Continued)

*Primary Examiner* — Steven A. Reynolds
*Assistant Examiner* — King M Chu
(74) *Attorney, Agent, or Firm* — Mohr Intellectual Property Law Solutions, PC

(57) ABSTRACT

Enclosure devices for storage and transport of art pieces are shown and described. The enclosure devices include a flat base, first and second side panels substantially perpendicularly disposed relative to the flat base, first and second sloped panels disposed at an angle relative to the flat base and the first and second side panels, an art piece receiving space disposed between the first side panel, the second side panel, and the flat base, and a canopy space substantially disposed between the first sloped panel and the second sloped panel. The art piece receiving space is configured to retain the art piece as the flat base contacts a back surface of the art piece. The canopy space is configured to be disposed above a medium applied surface of the art piece.

20 Claims, 14 Drawing Sheets

(56) References Cited

OTHER PUBLICATIONS

Jerry's Artarama, Jullian Canvas Carrying Case, Product Information available at http://www.jerrysartarama.com/discount-art-supplies/canvas-and-boards/canvas-carriers/jullian-canvas-carrying-case.htm, Mar. 13, 2015.
Jusdons Art Outfitters, Handy Porter (3 Pack), Product Information Available at http://www.judsonsart.com/pleinair/pc/Handy-Porter-3-pack-52p191.htm, Mar. 13, 2015.
Raymar Art, Wet Painting Carriers, Product Information Available at http://www.raymarart.com/Wet-Painting-Carriers-Wet-Panel-Carriers-s/21.htm, Mar. 13, 2015.
Champion Box Company, Inc., Totes for Wet Paintings, Product Information Available at http://www.champion-artmate.com/products/wettotes.htm, Mar. 13, 2015.
Wind River Arts, Wet Canvas Carriers, Product Information Available at http://www.windriverarts.com/wet_canvas_carriers.htm, Mar. 13, 2015.
Virtual Art Academy, Three Panel Carrier, Product Information Available at http://www.wetcanvas.com/Community/images/16-Nov-2009/158506-three_panel_carrier1.jpg, Mar. 13, 2015.
Artwork Essentials, Dry Box, Product Information Available at http://www.artworkessentials.com/products/DryBox/Drybox.htm, Mar. 13, 2015.
Artwork Essentials, Wet Panel Carrier, Product Information Available at http://www.artworkessentials.com/products/DB1012/DB1012.htm, Mar. 13, 2015.
Sun Eden Artists Gear, SunEden WEt Painting Carrier, Product Information Available at http://sun-eden.com/index.cfm?fuseaction=product.display&product_ID=3668,ParentCat=26 Mar. 13, 2015.
An Artist, Wet Painting Carriers, Product Information Available at http://nartizt.blogspot.com/2011/11/wet-painting-carriers.html, Mar. 13, 2015.
Lauraleffers, How to Make a Wooden Wet Painting Carrier, Product Information Available at https://lauraleffers.wordpress.com/2014/11/20/how-to-make-a-wooden-wet-painting-carrier/, Mar. 13, 2015.
Cheap Joe's Art Stuff, Craftech Sienna Plein Air Wet Panel Box, Large, Product Information Available at http://www.cheapjoes.com/catalog/product/view/id/20481/s/craftech-sienna-plein-air-wet-panel-box-large/category/7/, Mar. 13, 2015.
Plein Ari Liais, Military Wet Panel Carrier, Product Information Available at http://www.pleinairstyle.com/2012/12/military-wet-panel-carrier.html, Mar. 13, 2015.
Pleinair Painting Videos, How to Create a Wet Panel Carrier, Product Information Available at http://pleinair-painting-videos.com/video/how-to-create-a-wet-panel-carrier, Mar. 13, 2015.
Daily Artwork by Carolyn Jean Thompson, A Home-made Wet Painting Carrier for Plein Air, Product Information Available at http://dailyartbycj.blogspot.com/2012/06/home-made-wet-painting-carrier-for.html, Mar. 13, 2015.
Tim Paints, Wet Panel Carrier, Product Information Available at http://timpaints.blogspot.com/2011/03/wet-panel-carrier.html, Mar. 16, 2015.
Stapleton Kearns, Panel Boxes, Product Information Available at http://stapletonkearns.blogspot.com/2011/07/panel-boxes.html, Mar. 16, 2015.
kittygorrell.com, KG Kanvas Karriers, Product Information Available at http://www.kittygorrell.com/kanvaskarriers.php, Mar. 13, 2015.
Jerry's Artarama, Weber Wet Canvas Carrier, Product Information Available at http://www.jerrysartarama.com/discount-art-supplies/canvas-and-boards/canvas-carriers/weber-wet-canvas-carrier.htm.
Jerry's Artarama, ezART Shippers, Product Information Available at http://www.jerrysartarama.com/discount-art-supplies/art-shipping-supplies/ez-art-shippers.htm, Mar. 13, 2015.
Art Cocoon, Art Cocoons, Product Information Available at www.myartcocoon.com, Mar. 13, 2015.
Panelpak Artist's Wet Panel Carrier, Panel Pak, Product Information Available at http://www.panelpak.com/, Mar. 13, 2015.
Makki Senkarik, Boxing the Wet Painting, Product Information Available at http://mikkisenkarik.wordpress.com/2011/12/30/boxing-the-wet-painting/, Mar. 16, 2015.
Experimental Guru, Plein-Air Wet Canvas Carrier, Product Information Available at http://experimentalguru.blogspot.com/2009/05/plein-air-wet-canvas-carrier-tutorial.html, Mar. 13, 2015.
Jeanean Songco Martin Fine Art, Directions for Making an Inexpensive Painting Carrier, Product Information Available at http://jeaneansongcomartin.com/blog/61680/directions-for-making-an-inexpensive-painting-carrier, Mar. 16, 2015.
Oil Paintings by Kim C Pelletier, Plein Air Wet Painting Carrier, Product Information Available at http://kimcpell.ipower.com/artblog/?p=200, Mar. 16, 2015.
Marc Dalessio, Traveling with Wet Paintings Using a Wine Cork, Product Information Available at http://www.marcdalessio.com/traveling-with-wet-paintings/, Mar. 16, 2015.
Haidee-Jo Summers Artist, About Wet Paintings, Product Information Available at http://haideejo.blogspot.com/2014/03/about-wet-paintings.html, Mar. 16, 2015.
Zeh Original Art Blog, Shipping a Wet Oil Painting on Canvas—How to Do It, Product Information Available at http://blog.zehoriginalart.com/2013/05/shipping-wet-oil-painting-on-canvas-how.html, Mar. 16, 2015.
Wet-Case Wet Canvas Carrying Systyem, The Wet-Case, Product Inforamtion Available at http://www.wet-case.com/, Mar. 16, 2015.
Judsons Art Outfitters, 5×7 Pocket Box SECOND, Product Information Available at http://www.judsonsart.com/pleinair/pc/5×7-Pocket-Box-SECOND-104p1762.htm, Mar. 16, 2015.
Open Box M, Inc., Palettes, Product Information Available at http://www.openboxm.com/palette-panel-holders/, Mar. 16, 2015.
Judsons Art Outfitters, Guerrilla Painter 9×12 Pochade Box, Product Information Available at http://www.judsonsart.com/pleinair/pc/Guerrilla-Painter-9×12-Pochade-Box-5p1.htm, Mar. 16, 2015.
Alla Prima Pochade, About the Alla Prima Pochade Boxes, Product Information Available at http://alla-prima-pochade.myshopify.com/pages/about-us, Mar. 16, 2015.
Jerry's Artarama, Metal Wet Canvas Carriers, Product Information Available at http://www.jerrysartarama.com/discount-art-supplies/canvas-and-boards/canvas-carriers/wet-canvas-carriers.htm, Mar. 16, 2015.
Jerry's Artarama, The Protector Wet Canvas Carrier, Product Information Available at http://www.jerrysartarama.com/discount-art-supplies/canvas-and-boards/canvas-carriers/wet-canvas-carriers.htm, Mar. 16, 2015.
Jerry's Artarama, Jullian Wet Canvas and Panel Carrier, Product Information Available at http://www.jerrysartarama.com/discount-art-supplies/canvas-and-boards/canvas-carriers/jullian-wet-canvas-and-panel-carrier.htm, Mar. 16, 2015.
Jackson's, Medium Wooden Canvas Carrier, Product Information Available at http://www.jacksonsart.com/p28993/Medium_Wooden_Canvas_Carrier/product_info.html, Mar. 16, 2015.
Jackson's, Large Wooden Canvas Carrier holds Multiple Canvas, Product Information Available at http://www.jacksonsart.com/p28992/Large_Wooden_Canvas_Carrier_holds_multiple_canvas/product_info.html, Mar. 16, 2015.
Jackson's, Jackson's: A3 Black Course Work Carrier, Product Information Available at http://www.jacksonsart.com/p49858/Jacksons&2339;s_:_A3_Black_Course_Work_Carrier/product_info.html, Mar. 16, 2015.
Jackson's, A4 Portfolio 140 Micron Sleeves 20 Pack, Product Information Available at http://www.jacksonsart.com/p16091/A4_Portfolio_140_Micron_Sleeves_20pack/product_info.html, Mar. 16, 2015.
Jackson's, Single: A1 Archival Portfolio Sleeve, Product Information Available at http://www.jacksonsart.com/p28231/Single_:_A1_Archival_portfolio_sleeve/product_info.htm, Mar. 16, 2015.
Jackson's, Mapac: Quartz Portfolio : A3 Padded Nylon : Strong Rings : Shoulder Strap, Product Information Available at http://www.jacksonsart.com/p16070/Mapac_:_Quartz_Portfolio_:_A3_padded_nylon_:_strong_rings_:_shoulder_strap/product_info.html, Mar. 16, 2015.

(56) References Cited

OTHER PUBLICATIONS

Misterart!, Clear Canvas Schlepper, Product Information Available at http://www.misterart.com/canvas/accessories/fresh-art-clear-canvas-schlepper.html, Mar. 16, 2015.
The Yellow Art House, Love Handles, Product Information Available at http://www.yellowarthouse.com/love-handles.html, Mar. 16, 2015.
Jackson's, Canvas Carrier, Product Information Available at http://www.jacksonsart.com/p13920/Canvas_Carrier/product_info.html, Mar. 16, 2015.
Jerry's Artarama, Wet Canvas Carrying Clips, Product Information Available at http://www.jerrysartarama.com/discount-art-supplies/canvas-and-boards/canvas-carriers/wet-canvas-carrying-clips.htm.
Jerry's Artarama, Guerrilla Canvas Pins, Product Information Available at http://www.jerrysartarama.com/discount-art-supplies/canvas-and-boards/canvas-carriers/guerrilla-canvas-pins.htm, Mar. 16, 2015.
Tony Elington Art, Wet Panel Carrier Clips, Product Information Available at http://tonyelkingtonart.blogspot.com/2014/08/wet-panel-carrier-clips.html#.VHQDGIvF_At, Mar. 16, 2015.
Artist & Craftman Suppy, Jack Richeson Wet Canvas Carrier, Product Information Available at http://www.artistcraftsman.com/canvas-panels-1/canvas-stretching-tools/jack-richeson-wet-canvas-carrier.html, Mar. 16, 2015.
Kathy Cousart Fine Art, Painting Carrier Rack Inforamtion by Kathy Cousart, Product Information Available at http://www.kathycousart.com/painting-carrier-rack-information-by-kathy-cousart/, Mar. 16, 2015.

* cited by examiner

SYSTEMS, DEVICES, AND METHODS FOR ENCLOSING, TRANSPORTING, AND/OR STORING ART PIECES

BACKGROUND

The present disclosure relates generally to systems, devices, and methods for enclosing, transporting, and/or storing of substantially flat objects (e.g., flat art pieces, art canvases, etc.). In particular, systems, devices, and methods for enclosing, transporting, and/or storing of a flat art piece that limit contact of the device with a medium applied surface of the flat art piece are described.

Art piece carrying devices (e.g., canvas carrying devices) are used to transport and/or store art pieces. Currently used art piece carrying devices generally have parallel planar upper and lower panels that contact or are proximal to planar upper and lower surfaces of the art piece, including a medium applied surface of the art piece.

Known art pieces carrying devices are not entirely satisfactory for the range of applications in which they are employed. For example, existing art piece carrying devices may come into contact with the medium applied surface and cause damage to the medium applied surface (e.g., smudging, smearing, puncturing, tearing, etc.). Damage to the medium applied surface may decrease the value of the art piece. In some cases, damage to the medium applied surface may destroy the art piece.

In addition, some other conventional art piece carrying devices lack parallel planar panels and instead include a concaved panel configured to be proximal to the medium applied surface and require multiple attachment members to attach the concaved panel to a perimeter of the art piece. These other conventional art piece carrying devices have the disadvantage described above and have the additional disadvantage that they provide no panels or barriers to protect other sides of the art piece (e.g., perimeter edges, a non-medium applied surface, etc.).

Thus, there exists a need for systems, devices, and methods for enclosing, transporting, and/or storing of art pieces that improve upon and advance the design of known art piece carrying devices. Examples of new and useful systems, devices, and methods for enclosing, transporting, and/or storing of art pieces relevant to the needs existing in the field are discussed below.

Disclosure addressing one or more of the identified existing needs is provided in the detailed description below. Examples of references relevant to art piece carrying devices include U.S. Pat. No. 188,199, U.S. Pat. No. 295,030, U.S. Pat. No. 408,937, U.S. Pat. No. 641,283, U.S. Pat. No. 682,493, U.S. Pat. No. 728,450, U.S. Pat. No. 941,212, U.S. Pat. No. 1,175,070, U.S. Pat. No. 1,432,336, U.S. Pat. No. 2,221,024, U.S. Pat. No. 2,288,325, U.S. Pat. No. 2,648,933, U.S. Pat. No. 2,804,226, U.S. Pat. No. 2,875,934, U.S. Pat. No. 2,950,001, U.S. Pat. No. 2,976,985, U.S. Pat. No. 3,189,173, U.S. Pat. No. 3,223,235, U.S. Pat. No. 3,281,031, U.S. Pat. No. 3,563,432, U.S. Pat. No. 4,029,208, U.S. Pat. No. 4,061,224, U.S. Pat. No. 4,072,230, U.S. Pat. No. 4,081,119, U.S. Pat. No. 4,084,263, U.S. Pat. No. 4,156,498, U.S. Pat. No. 4,446,968, U.S. Pat. No. 4,471,849, U.S. Pat. No. 4,487,443, U.S. Pat. No. 4,493,504, U.S. Pat. No. 4,664,254, U.S. Pat. No. 4,690,363, U.S. Pat. No. 4,881,771, U.S. Pat. No. 5,259,523, U.S. Pat. No. 5,326,147, U.S. Pat. No. 5,544,806, U.S. Pat. No. 6,048,570, U.S. Pat. No. 6,182,465, U.S. Pat. No. 6,412,838, U.S. Pat. No. 6,431,349, U.S. Pat. No. 7,108,141, U.S. Pat. No. 8,087,633, and Patent Application No. 20040232025. The complete disclosures of the above patents and patent applications are herein incorporated by reference for all purposes.

SUMMARY

The present disclosure is directed to enclosure devices for storage and transport of art pieces. The enclosure devices include a flat base, first and second side panels substantially perpendicularly disposed relative to the flat base, first and second sloped panels disposed at an angle relative to the flat base and the first and second side panels, an art piece receiving space substantially disposed between the first side panel, the second side panel, and the flat base, the art piece receiving space configured to retain the art piece as the flat base contacts a back surface of the art piece, and a canopy space substantially disposed between the first sloped panel and the second sloped panel, the canopy space configured to be disposed above a medium applied surface of the art piece. In some examples, the canopy space is a triangular prism canopy space. In some further examples, enclosure devices include openings at opposing ends of the enclosure device and barriers for selectively opening and closing the openings.

DETAILED DESCRIPTION

Figure 1:
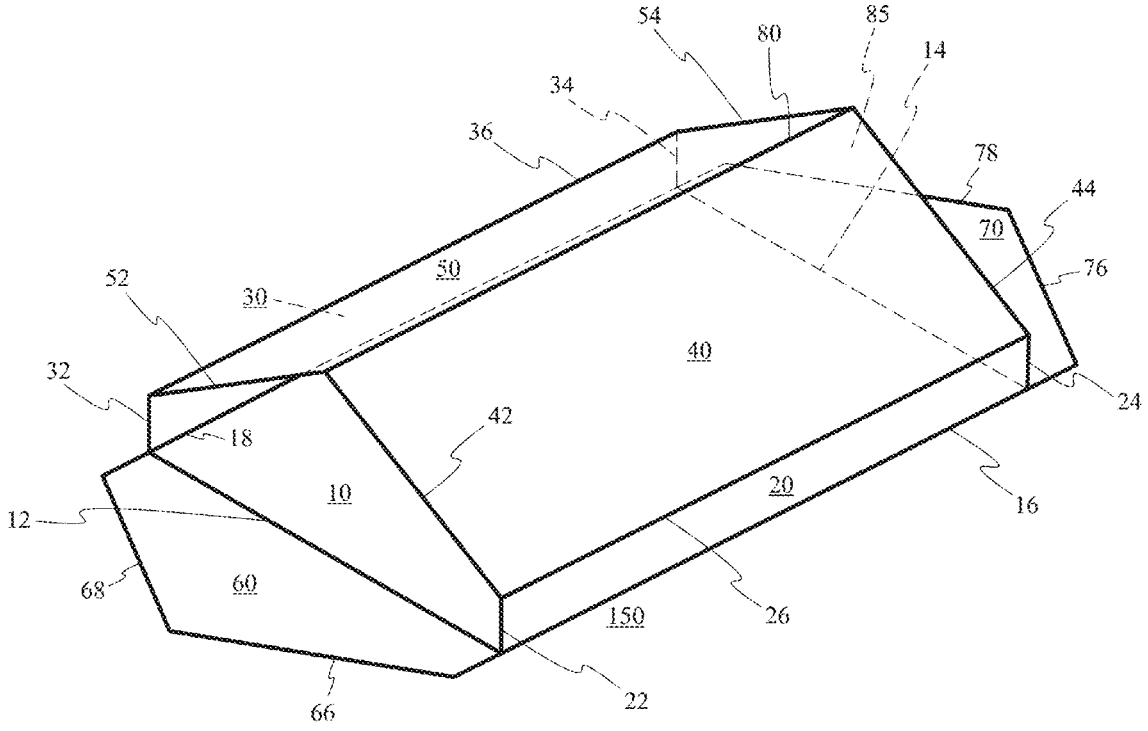
FIG. 1 is an isometric view of a first example enclosure device.
Figure 2:
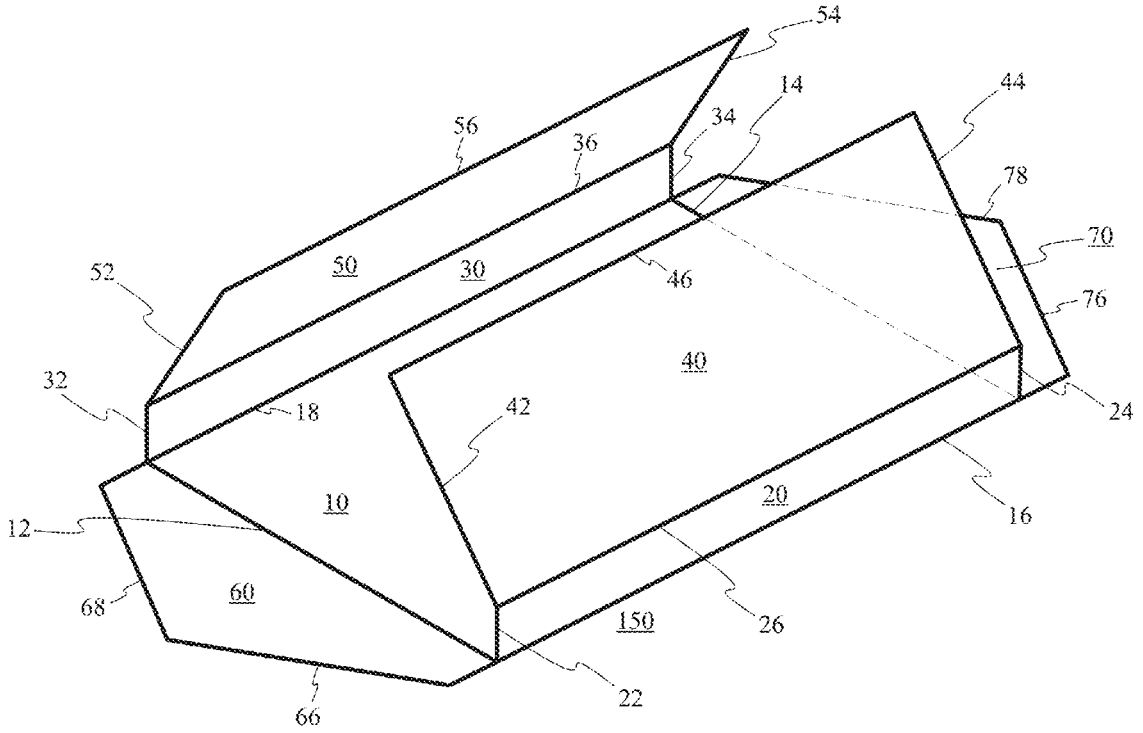
FIG. 2 is an isometric view of the first example enclosure device of FIG. 1 illustrating both barriers open and an apex ridge uncoupled.
Figure 3:
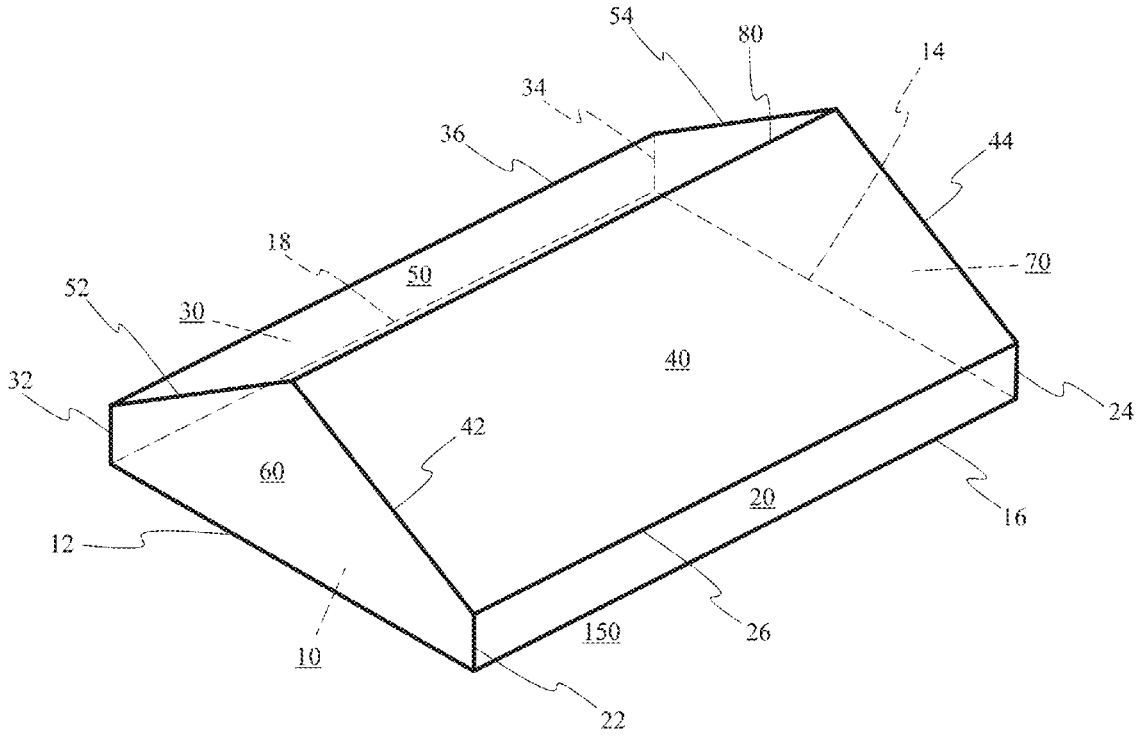
FIG. 3 is an isometric view of the first example enclosure device of FIG. 1 illustrating both barriers closed.

The disclosed systems, devices, and methods for enclosing, transporting, and/or storing of art pieces will become better understood through review of the following detailed description in conjunction with the figures. The detailed description and figures provide merely examples of the various inventions described herein. Those skilled in the art will understand that the disclosed examples may be varied, modified, and altered without departing from the scope of the inventions described herein. Many variations are contemplated for different applications and design considerations; however, for the sake of brevity, each and every contemplated variation is not individually described in the following detailed description.

Throughout the following detailed description, examples of various systems, devices, and methods for enclosing, transporting, and/or storing of art pieces are provided. Related features in the examples may be identical, similar, or dissimilar in different examples. For the sake of brevity, related features will not be redundantly explained in each example. Instead, the use of related feature names will cue the reader that the feature with a related feature name may be similar to the related feature in an example explained previously. Features specific to a given example will be described in that particular example. The reader should understand that a given feature need not be the same or similar to the specific portrayal of a related feature in any given figure or example.

With reference to FIGS. 1-7, a first example of a device for enclosing, transporting, and/or storing of art pieces, enclosure device 150, will now be described. Enclosure device 150 includes one flat base 10, two side panels 20 and 30, two sloped panels 40 and 50, and two gates or barriers 60 and 70 at opposing ends of the enclosure device. Flat base 10 is substantially rectangular in shape and shares each length edge 16 and 18 with side panels 20 and 30, respectively. Further, flat base 10 shares each width edge 12 and 14 with barriers 60 and 70, respectively.

Side panels 20 and 30 are rectangular in shape with length edges 16 and 18 attached to the flat base 10 and other length edges 26 and 36 attached to sloped panels 40 and 50, respectively. Sloped panels 40 and 50 are also rectangular in shape with length edges 26 and 36 attached to side panels 20 and 30, respectively. Sloped panels 40 and 50 have length edges 46 and 56, respectively, which are connectable and/or attachable (shown in FIG. 2). An apex ridge 80 is formed where the length edges 46 and 56 meet.

When edges 46 and 56 are connected, width edges 12, 22, 32, 42, and 52 of the five rectangular panels (i.e., flat base 10, side panels 20 and 30, and sloped panels 40 and 50) comprise a pentagon-shaped opening 84 on one end of the enclosure device. Further, width edges 14, 24, 34, 44, and 54 of the five rectangular panels comprise a pentagon-shaped opening 85 on a second opposing end of the enclosure device. Barriers 60 and 70 are complimentarily configured to openings 84 and 85. Barriers 60 and 70 can be operatively hinged or otherwise operatively coupled to the width edges 12 and 14, respectively. Barriers 60 and 70 are configured to move from an open position (shown in FIG. 1) to a closed position (shown in FIG. 3) to close openings 84 and 85, respectively, and thereby close the enclosure device.

Figure 6:
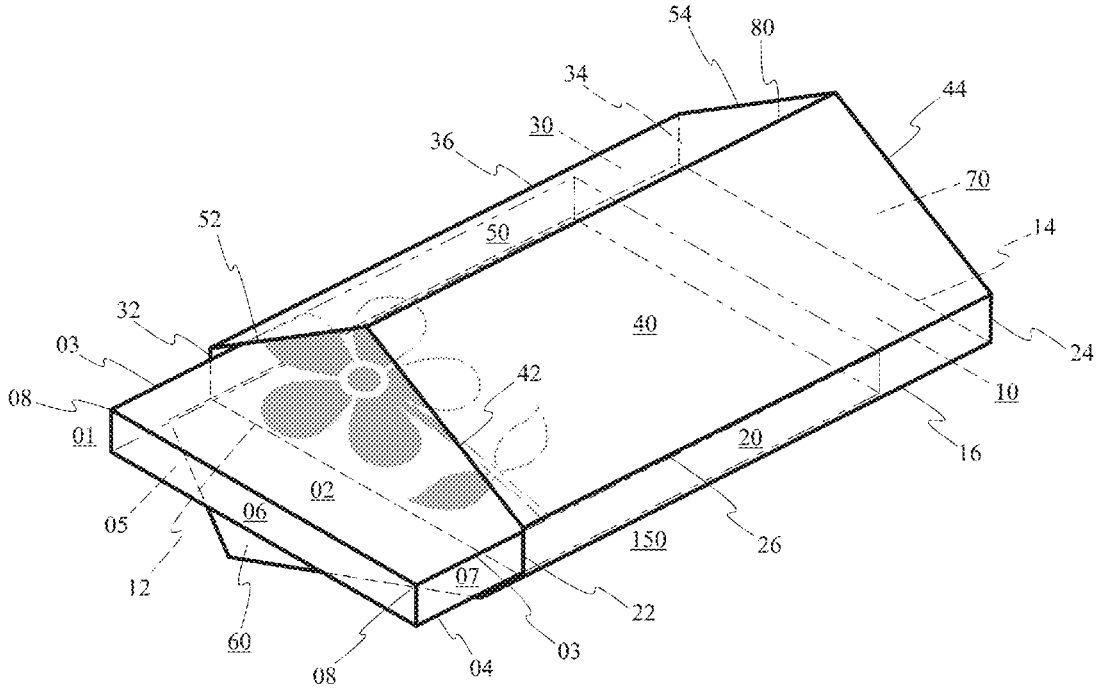
FIG. 6 is an isometric view of the first example enclosure device of FIG. 1 illustrating the art piece of FIG. 5 being inserted into the enclosure device.
Figure 7:
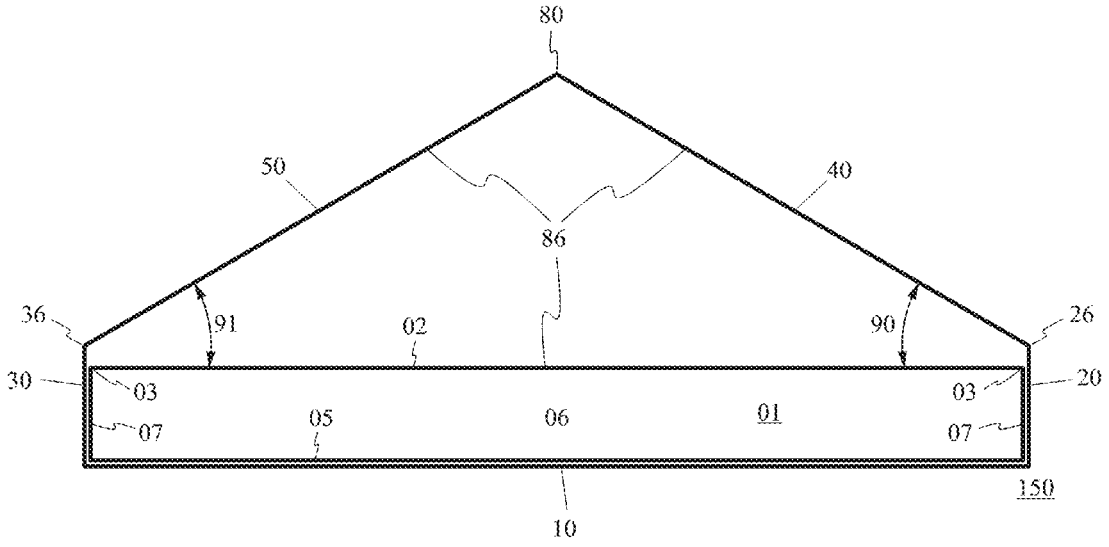
FIG. 7 is a front view of the first example enclosure device of FIG. 1 illustrating the enclosure access with the inserted art piece.

Accordingly, barriers 60 and 70 provide independent securable access that open and close allowing an art piece 01 (shown in FIGS. 5-7) to enter and exit enclosure device 150 without contact to a medium applied surface 02. As shown in FIGS. 6 and 7, a backside 05 and bottom length edges 04 of the art piece predominately makes contact with flat base 10. Further, when closed, barriers 60 and 70 provide additional structural support to pentagon-shaped openings 84 and 85. Alternatively, the art piece can enter and exit the enclosure device through a top opening when length edges 46 and 56 are uncoupled.

Figure 4:
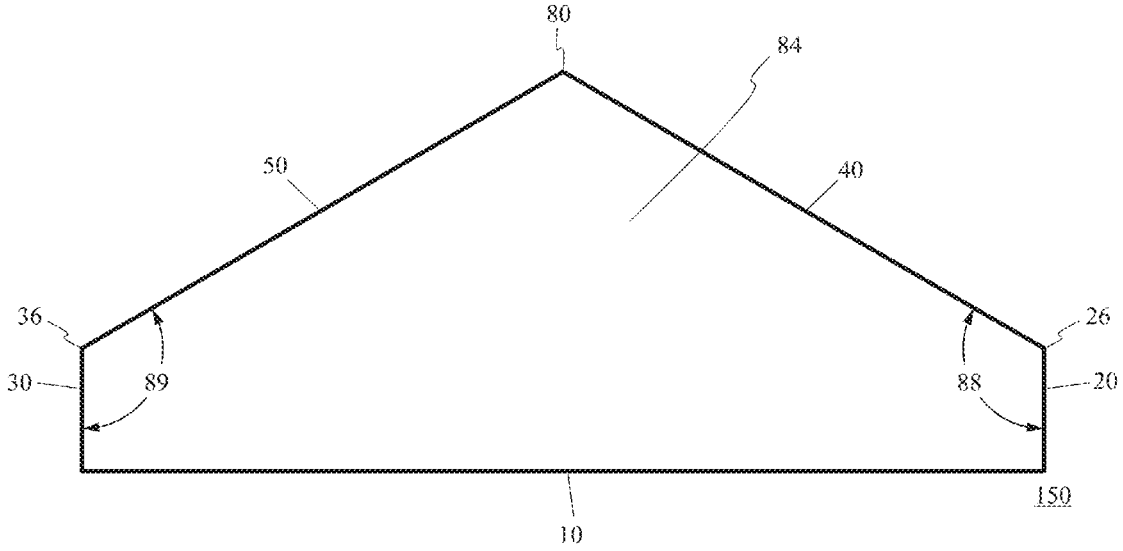
FIG. 4 is a front view of the first example enclosure device of FIG. 1.
Figure 5:
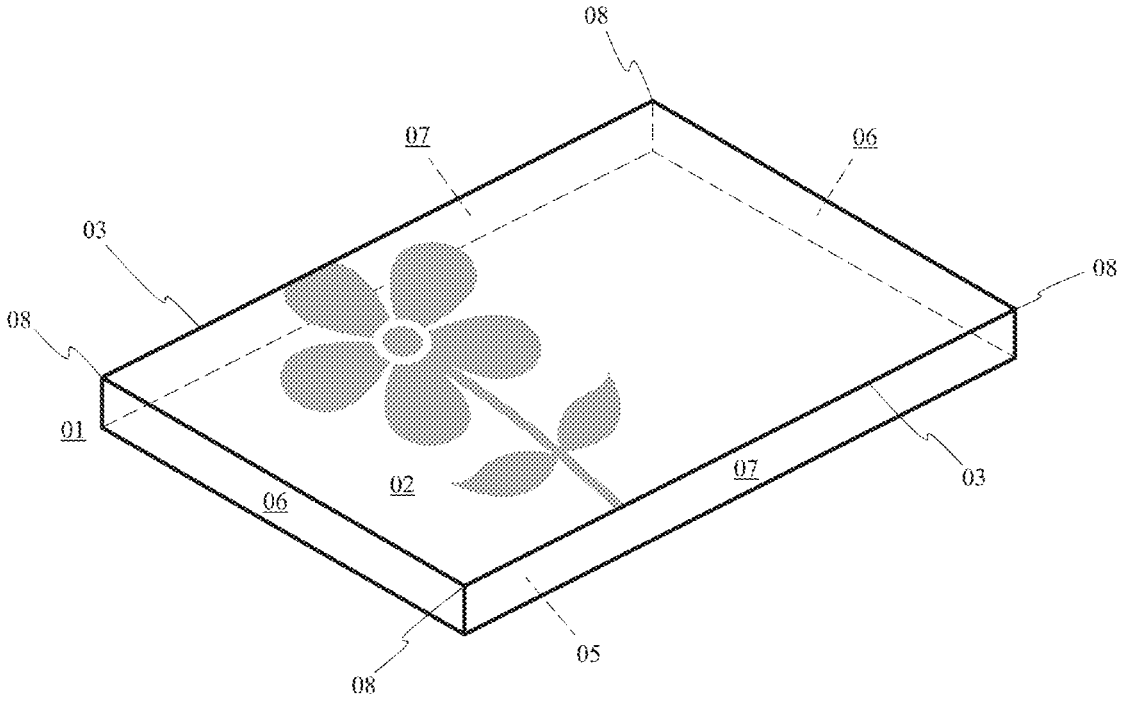
FIG. 5 is an isometric view of an example art piece having a medium applied surface.

Turning now to FIGS. 4 and 7, side panels 20 and 30 in combination with sloped panels 40 and 50 form the openings. It will be appreciated that although only opening 84 is shown in FIG. 4, opening 85 has a substantially similar configuration. An intersection between side panel 20 and sloped panel 40 forms a first obtuse angle 88, while an intersection between side panel 30 and sloped panel 50 forms a second obtuse angle 89. Obtuse angles 88 and 89 run the entire length of widths 26 and 36, respectively.

As shown in FIG. 7, sloped panels 40 and 50 (including apex ridge 80) create a triangular canopy space 86 (i.e., a triangular prism canopy space). Sloped panels 40 and 50 atop side panels 20 and 30 provide structural integrity to triangular canopy space 86. Specifically, sloped panels 40 and 50 atop side panels 20 and 30 provide structural integrity and space directly over medium applied surface 02. Not only does the triangular canopy design 86 provide strength, but the distance of the apex ridge 80 from the art piece applied medium surface 02 provides a buffer/crush/impact zone for increased protection over conventional art piece carrying systems.

Additionally, apex ridge 80 on the overall pentagonal profile shape of enclosure device 150 always indicates to a user, observer, and/or transporter the orientation of art piece 01 and medium applied surface 02 inside the enclosure device. Further, the pentagonal profile shape provides a natural hand contour for holding purposes without the aid of a handle.

Side panels 20 and 30 have a height that is slightly greater than a height of perimeter faces height 06 and 07. Thus, side panels 20 and 30 are slightly higher than medium applied surface 02 and can accommodate art piece 01 even with a very thick (e.g., impasto) applied medium when the art piece inserted and/or otherwise moved into the enclosure device. It will be appreciated that intersections between side panels 20 and 30 do not need to be true ninety degrees relative the flat base 10, but can deviate in either direction to complete the five-sided structure.

Once art piece 01 is inside enclosure device 150, medium applied surface 02 is a top-most surface of the art piece and substantially subtracts approximately ninety degrees of obtuse angles 88 and 89. Remaining portions of obtuse angles 88 and 89 form acute angles 90 and 91 (i.e., angles less than 90 degrees), respectively. Significantly, acute angles 90 and 91 are angles where sloped panels 40 and 50 are angled away from medium applied surface 02 and thereby sloped panels 40 and 50 are non-parallel surfaces relative to medium applied surface 02 and flat base 10. Further, sloped panels 40 and 50 disposed at acute angles 90 and 91 limit contact between enclosure device 150 and medium applied surface 02. In some cases, a minimal degree of contact may be made between the enclosure device and the finite outermost perimeter of the medium applied surface (e.g., top length edges 03 of art piece 01).

Turning attention to FIGS. 8-11, a second example of a device for enclosing, transporting, and/or storing of art pieces, enclosure device 250 will now be described. Enclosure device 250 includes many similar or identical features to enclosure device 150. Thus, for the sake of brevity, each feature of enclosure device 250 will not be redundantly explained. Rather, key distinctions between enclosure device 250 and enclosure device 150 will be described in detail and the reader should reference the discussion above for features substantially similar between the two enclosure devices.

Figure 9:
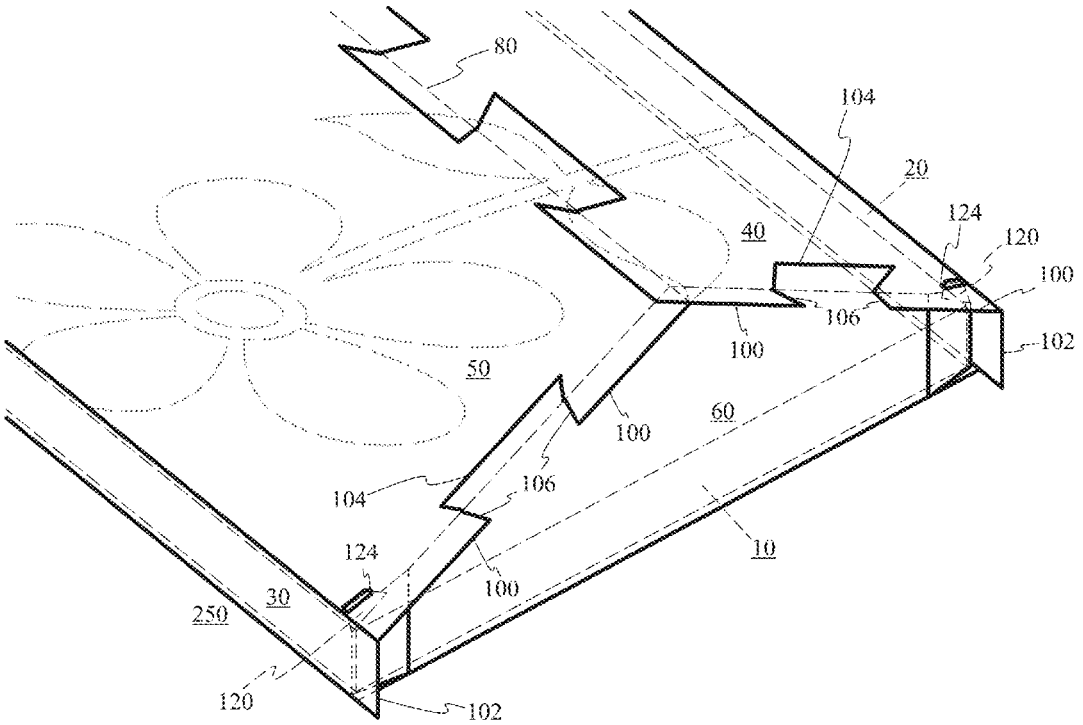
FIG. 9 is an isometric view of the second example enclosure device illustrating the barrier in a closed position.

As can be seen in FIG. 9, in enclosure device 250, side panels 20 and 30 and sloped panels 40 and 50 extend beyond barriers 60 to create side panel extensions 102 and sloped panel extensions 100, respectively. Sloped panel extensions 100 and side panel extensions 102 provide impact absorbing areas around barriers 60 (i.e., opposing end perimeters of the enclosure device). Sloped panel extensions 100 coupled with side panel extensions 102 cooperatively limit damage that may be caused by falling and/or dropping of the enclosure device onto a surface.

As depicted in FIGS. 8-11, barrier 60 includes pliant barrier tabs 110 at the outer most side edges of the barrier that can be folded inward because they are not attached to the flat base (i.e., via cuts 114). Pliant barrier tabs 110 have a pliant barrier nub 120 that can be extended through sloped panel nub slots 124. Pliant barrier tabs 110 have pliant barrier creases 112 where pliant barrier tab 110 will bend when the pliant barrier side edge 116 is pushed slightly inward near the conjunction of pliant barrier side edges 116, pliant barrier top edges 118, and pliant barrier nub creases 122. Once pliant barrier tabs 110 are inwardly pressed pliant barrier nubs 120 can be secured into sloped panel nub slots 124. Pliant barrier nubs 120 secure the pliant barrier tabs 110 in place.

Figure 8:
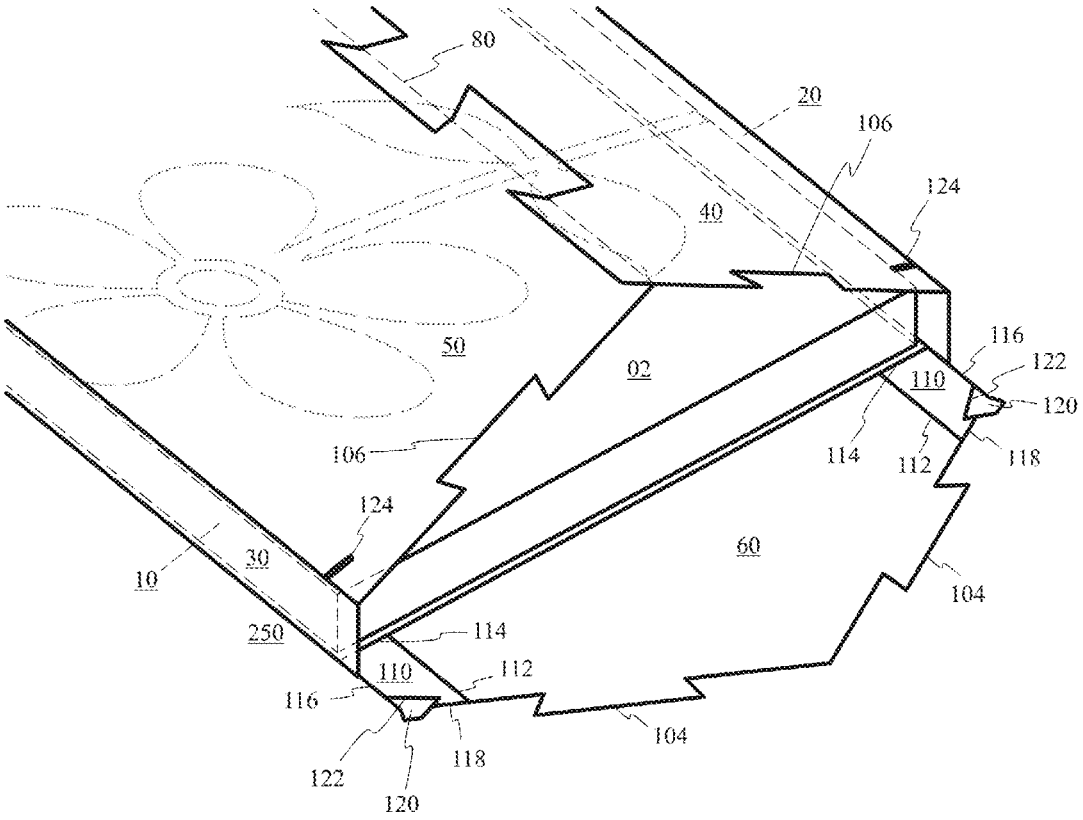
FIG. 8 is an isometric view of a second example enclosure device having pliant barrier tabs, side and sloped panel extensions, and interlocking tabs and recesses.
Figure 10:
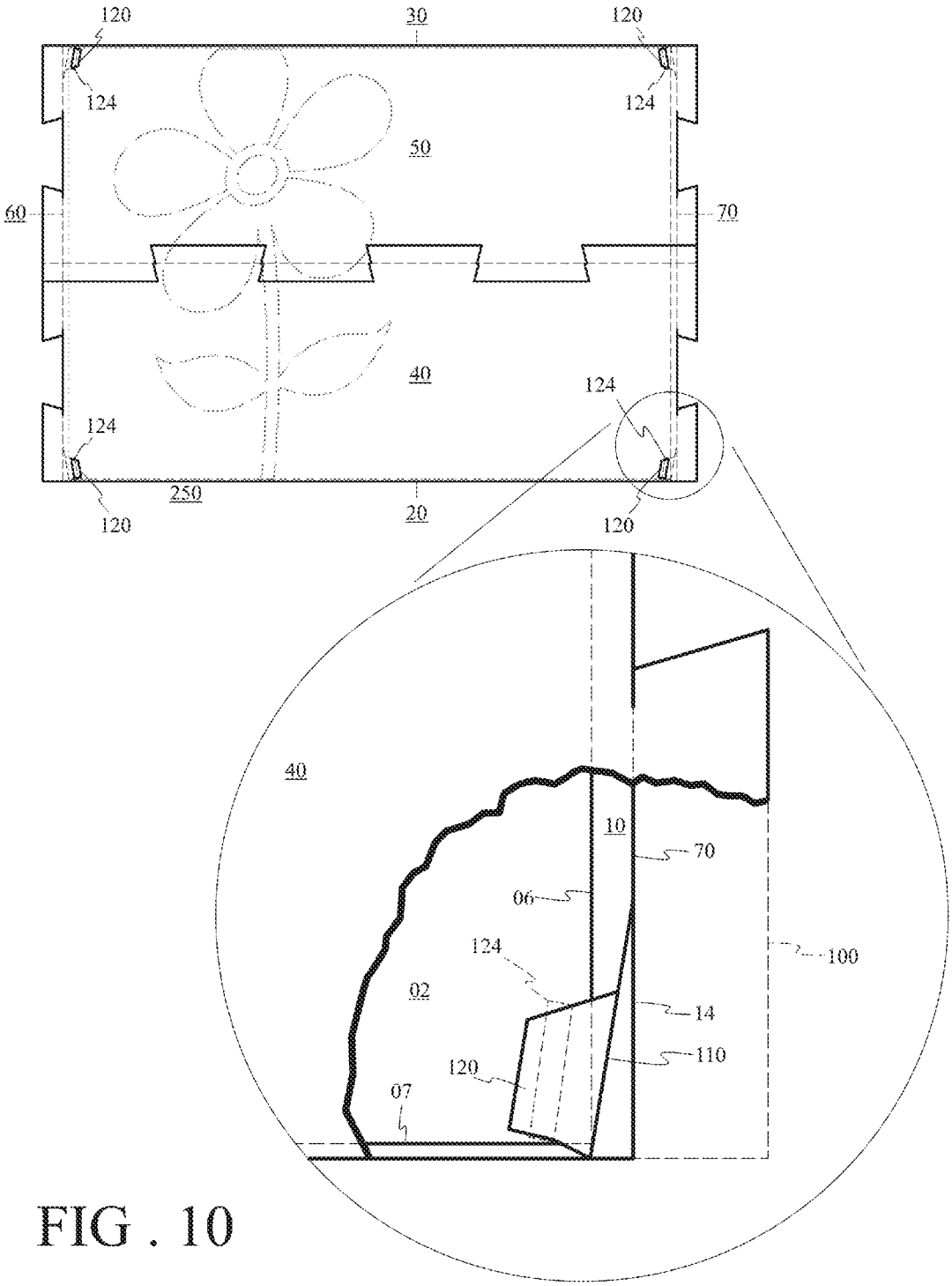
FIG. 10 is a top view with a cutaway callout of the second example enclosure device illustrating the pliant barrier tabs the barriers closed.
Figure 11:
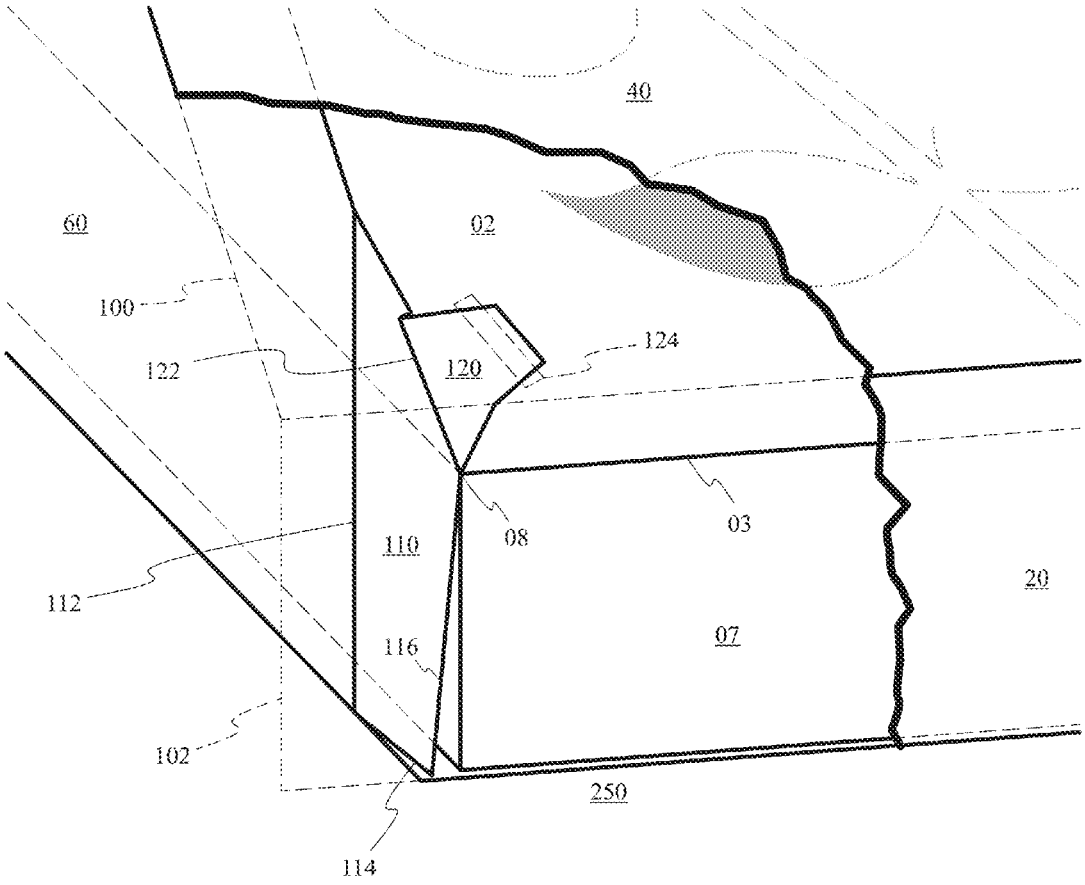
FIG. 11 is an isometric cutaway view of the second example enclosure device illustrating the pliant barrier tabs with the barriers dosed.

Also depicted in FIGS. 8, 10, and 11, sloped panel extensions 100 provide additional surface for pliant barrier tabs 110 to properly function. Specifically, sloped panel extensions 100 are configured to contribute to retaining pliant barrier nubs 120 (i.e., distal ends of pliant barrier tabs 110) in nub slots 124 even if an impact occurs on sloped panel extensions 100 and side panel extensions 102. Sloped panel extensions 100 are further configured to secure barriers 60 and 70 by means of panel intersecting coupling members, such as protruding interlocking tabs 104 and recesses 106 shown in FIGS. 8 and 9. It will be appreciated that although only one end of enclosure device (i.e., the end including barrier 60) is shown in FIGS. 8-11, the opposing end (i.e., the opposing end including barrier 70) has a substantially similar configuration.

Pliant barrier tabs 110 are a secondary feature to the triangular canopy 86 to further secure art piece 01 at art piece corners 08 (shown in FIGS. 10 and 11). The pliant barrier tabs 110 have two functions. The first function of pliant barrier tabs 110 is to stabilize art piece 01 through pressure against width faces 06 and length faces 07 of the art piece. This pressure can grip and center the art piece between the barriers and the side panels without contact to the medium applied surface via cooperative action of the barrier tabs. Additionally, this pressure provides a flexible cushion to secure the art piece within the enclosure device.

The second function of the pliant barrier tabs 110 is to conform to the top most corner of the art piece with a slight inward pressure, holding the art piece against the flat base without contact to the medium applied surface (shown in FIG. 11). These features can allow the enclosure device containing an art piece to be inverted or positioned at any orientation while safely protecting the art piece and its medium applied surface. Should any of the pliant barrier tabs fail, the pentagonal structured body has an engineered failsafe. This engineered failsafe is the side panels and sloped panels intersecting at length edges and restricting movement and/or shifting of the art piece within the enclosure (show in FIG. 7).

The enclosure device can be assembled and secured in a variety of ways; however, it will be appreciated that if the enclosure is not secured at the barrier ends after the art piece is inside the enclosure, the open enclosure still provides some protection over the art piece. This is an open storage feature of the art piece enclosure device, which can be converted into a storage and transportation art piece enclosure device by securing the barrier ends.

As shown in FIGS. 8 and 9, one way the enclosure can be secured is by interlocking tabs 104 and recesses 106. Interlocking tabs 104 and recesses 106 secure the enclosure while providing a self-restricting lock that can be opened and closed securely multiple times. Interlocking tabs 104 and recesses 106 are typically located at the edges of two intersecting panels, such as at intersecting edges 42 and 66, intersecting edges 52 and 68, intersecting edges 46 and 56, intersecting edges 44 and 76, and intersecting edges 54 and 78. When coupled with recesses 106, tabs 104 extend beyond the intersection where two panels meet. Inner surfaces of the tabs 104 make contact with inner edges of the recesses 106. Recesses 106 recede away from the extended edge to the intersection where two panels meet. Recesses 106 are configured to releasably the corresponding tabs 104, as tabs 104 are outwardly tapered. It will be appreciated that in other examples the interlocking tabs and recesses can be located where any two adjoining panels converge and can have any desired shape capable of interlocking.

Figure 12:
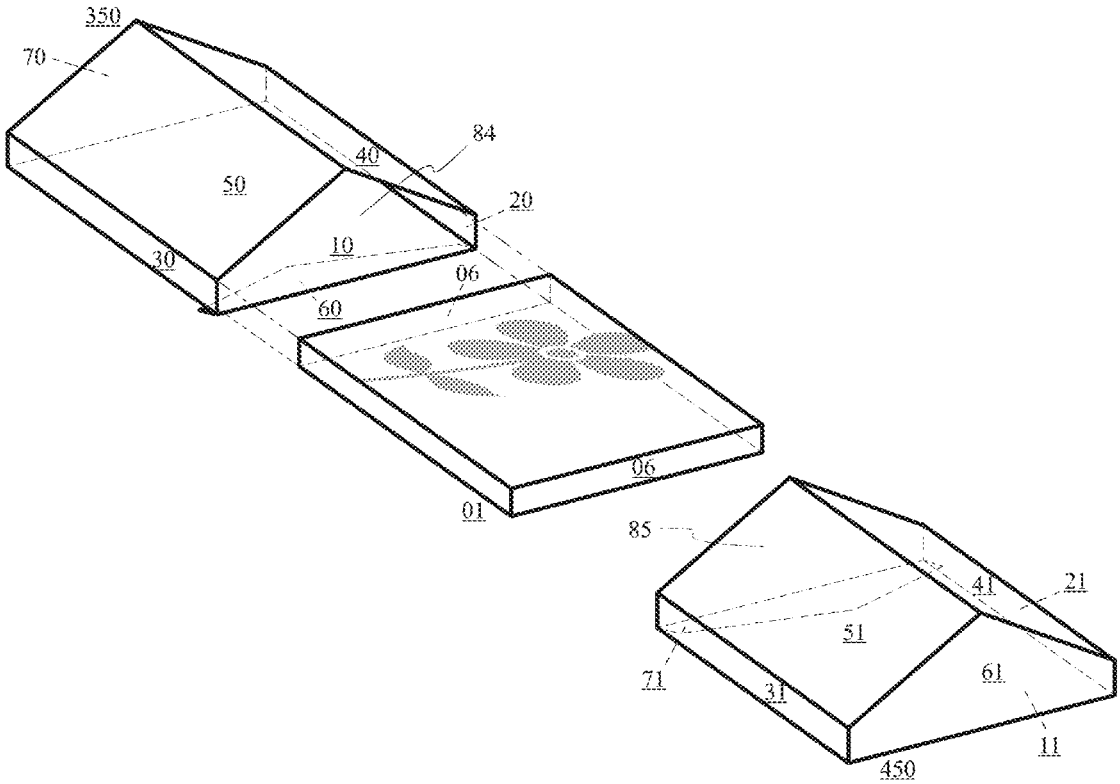
FIG. 12 is an isometric exploded view of a third example enclosure device having a telescoping lid.
Figure 13:
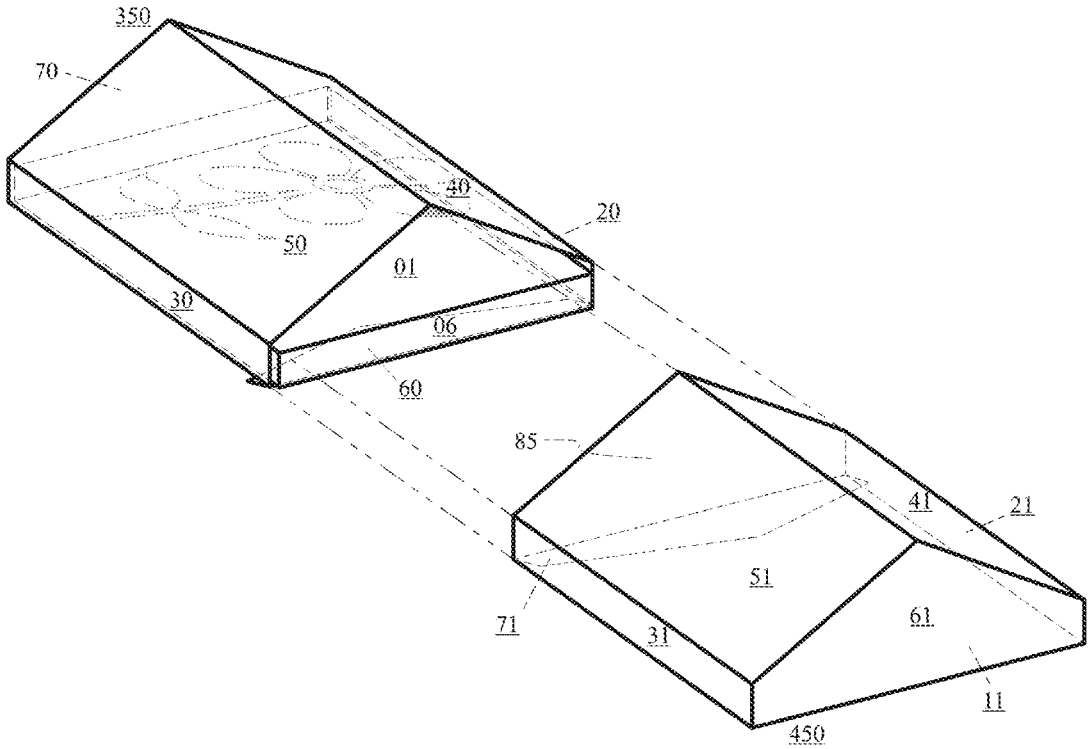
FIG. 13 is an isometric exploded view of the third example enclosure device illustrating the art piece disposed within the enclosure device.
Figure 14:
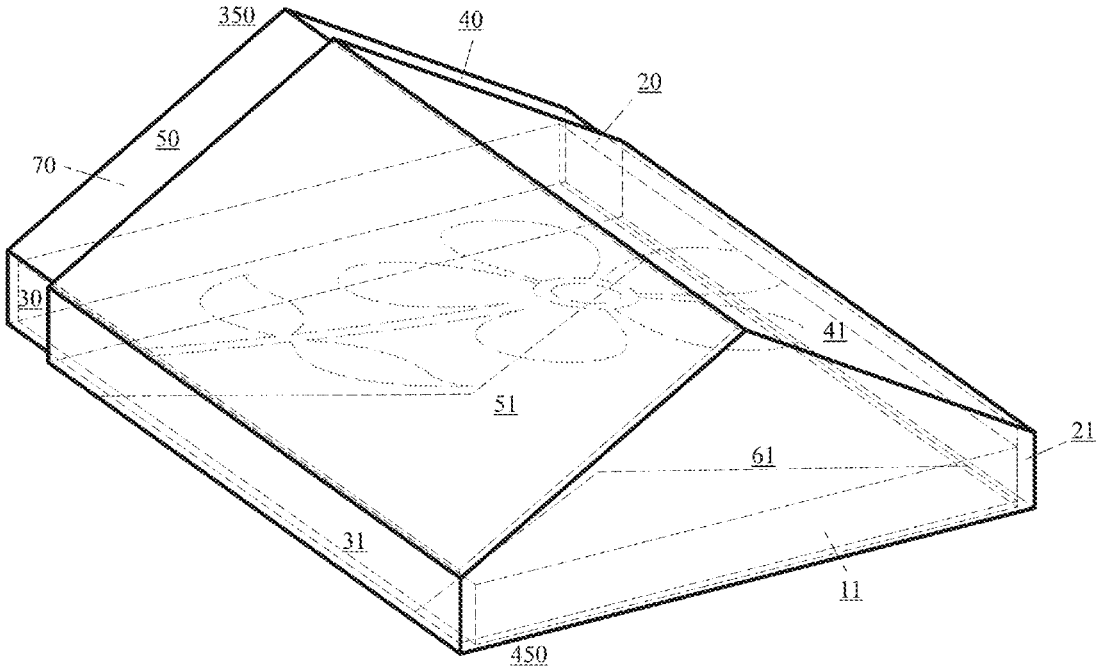
FIG. 14 is an isometric view of the third example enclosure device illustrating a closed position where the lid is inserted over the enclosure device.

Turning attention to FIGS. 12-14, a third example of a device for enclosing, transporting, and/or storing of art pieces, enclosure device 350 will now be described. Enclosure device 350 includes many similar or identical features to enclosure devices 150 and 250. Thus, for the sake of brevity, each feature of enclosure device 350 will not be redundantly explained. Rather, key distinctions between enclosure device 350 and enclosure devices 150 and 250 will be described in detail and the reader should reference the discussion above for features substantially similar between the three enclosure devices.

FIGS. 12-14 show another mechanism by which a device for enclosing, transporting, and/or storing of art pieces can be closed including a telescoping feature. Enclosure device 350 includes a similarly shaped body (i.e., a body having a pentagonal profile) to enclosure devices 150 and 250 comprised of flat base 10, two side panels 20 and 30, two sloped panels 40 and 50 having barriers 60 and 70 operatively coupled to the flat base.

Differently from enclosure devices 150 and 250, barrier 60 is positioned and/or folded under flat base 10. Art piece 01 can be slid into opening 84 until width face 06 contacts barrier 70. A slightly larger and complimentarily shaped (i.e., complimentarily configured to enclosure device 350) lid structure 450 having a flat base 11, side panels 21 and 31, sloped panels 41 and 51, with barriers 61 and 71 operatively coupled to flat base 11 is configured to slide over the enclosure device. Specifically, barrier 71 is positioned inside the enclosure over flat base 11. Lid structure 450 can telescope over smaller enclosure device 350 into opening 85 until barrier 61 contacts width face 06. Barriers 61 and 70 create a pressure on opposing width faces 06 to keep the art piece secured within enclosure device 350.

As described above, the example art piece enclosure devices (e.g., enclosure devices 150, 250, and 350) function to secure, store, retain, and/or position an art piece within the enclosure device while limiting contact with a medium applied surface of the art piece. Additionally or alternatively, the example art piece enclosure devices can be used to protect the art piece if the enclosure device is dropped. Further, additionally or alternatively, the example art piece enclosure devices can provide a mechanism for gripping and/or handling the enclosure device without an additional handle being added to the structure. It will be appreciated that the example art piece enclosure devices address many of the shortcomings existing with conventional art piece carrying devices identified above. It will be further appreciated that the example enclosure devices can be made of any desired material that is sufficiently rigid and sufficiently pliable to perform the above described functions (e.g., card board, plastic, etc.) and/or the example enclosure devices can be made to have any desired dimensions (e.g., sized to enclose a large art piece, a medium sized art piece, a small art piece, etc.).

In other contemplated examples, the triangular canopy over the art piece may consist of more than two panels, arched or curved polygonal structures, and/or a plateau replacing the apex ridge of the enclosure device. Further, the polygon structure can be symmetrical or asymmetrical. Furthermore, intersecting coupling members used to secure the enclosure can be used with or without an adhesive. If additional securing means are used in creating or securing the enclosure, they can include a flexible linear material that can be used to wrap, strap, tie, lace, stitch, hook and loop, bind, and/or any other securing or adhesive means known or yet to be discovered.

Further still, structured features resembling boxed corners can be positioned above the sloped panels and parallel to the flat base to create a flat stackable surface attached to or separate from the five-sided enclosure devices and may be comprised of individual boxed corners or a single rectangular box shape encompassing the enclosure device. In these examples, the enclosure device can be stacked and/or otherwise used in combination with other enclosure devices. The stackable feature increases the structural strength by transcending the vertical load down to the flat base. The stackable feature may also provide additional bumper and crush zones if the enclosure is dropped. The stackable feature may also guard the barrier tabs from unwanted opening. In even another example, additional handles can be used with the art piece enclosure device or in combination with the stackable feature.

The disclosure above encompasses multiple distinct inventions with independent utility. While each of these inventions has been disclosed in a particular form, the specific embodiments disclosed and illustrated above are not to be considered in a limiting sense as numerous variations are possible. The subject matter of the inventions includes all novel and non-obvious combinations and subcombinations of the various elements, features, functions and/or properties disclosed above and inherent to those skilled in the art pertaining to such inventions. Where the disclosure or subsequently filed claims recite "a" element, "a first" element, or any such equivalent term, the disclosure or claims should be understood to incorporate one or more such elements, neither requiring nor excluding two or more such elements.

Applicant(s) reserves the right to submit claims directed to combinations and subcombinations of the disclosed inventions that are believed to be novel and non-obvious. Inventions embodied in other combinations and subcombinations of features, functions, elements and/or properties may be claimed through amendment of those claims or presentation of new claims in the present application or in a related application. Such amended or new claims, whether they are directed to the same invention or a different invention and whether they are different, broader, narrower or equal in scope to the original claims, are to be considered within the subject matter of the inventions described herein.

The invention claimed is:

1. An enclosure device for one or more of storage and transport of an art piece having a medium applied surface and an opposing back surface, the enclosure device comprising:

a flat base having a first length edge, a second length edge, a first width edge, and a second width edge;

a first side panel substantially perpendicularly disposed relative to the flat base and sharing the first length edge, the first side panel having a third length edge opposing the first length edge;

a second side panel substantially perpendicularly disposed relative to the flat base and sharing the second length edge, the second side panel having a fourth length edge opposing the second length edge;

a first sloped panel disposed at an angle relative to the flat base and sharing the third length edge, the first sloped panel being disposed at a first obtuse angle relative to the first side panel;

a second sloped panel disposed at an angle relative to the flat base and sharing the fourth length edge, the second sloped panel being disposed at a second obtuse angle relative to the second side panel;

an art piece receiving space substantially disposed between the first side panel, the second side panel, and the flat base, the art piece receiving space configured to retain the art piece, the flat base configured to contact the back surface;

a canopy space substantially disposed between the first sloped panel and the second sloped panel, the canopy space configured to be disposed above the medium applied surface;

a first opening partially bordered by the first width edge and a second opposing opening partially bordered by the second width edge; and a first barrier operatively hinged to the first width edge, the first barrier being movable between an open position and a closed position to correspondingly open and close the first opening, wherein the first opening is a pentagon-shaped opening and the first barrier is a pentagon-shaped barrier.

2. The enclosure device of claim 1, wherein the first sloped panel further comprises a fifth longitudinal edge opposing the third longitudinal edge and the second sloped panel further comprises a sixth longitudinal edge opposing the fourth longitudinal edge, the fifth longitudinal edge being selectively attachable to the sixth longitudinal edge, and wherein the enclosure device further comprises an apex ridge when the fifth longitudinal edge is attached to the sixth longitudinal edge.

3. The enclosure device of claim 2, wherein the fifth longitudinal edge and the sixth longitudinal edge have one or more interlocking tabs and recesses for selectively mating the fifth longitudinal edge to the sixth longitudinal edge.

4. The enclosure device of claim 2, where in the canopy space is a triangular prism canopy space.

5. The enclosure device of claim 1, further comprising a second barrier operatively hinged to the second width edge, the second barrier being movable between the open position and the closed position to correspondingly open and close the second opening.

6. The enclosure device of claim 5, wherein the second opening is a pentagon-shaped opening and the second barrier is a pentagon-shaped barrier.

7. The enclosure device of claim 1, wherein the first sloped panel further comprises a third width edge and the second sloped panel further comprises a fourth width edge, the first barrier having a first angled edge that is selectively matable with the third width edge and a second angled edge that is selectively matable with the fourth width edge, and the first angled edge, the second angled edge, the third width edge, and the fourth width edge have one or more interlocking tabs and recesses for selectively mating the first angled edge to the third width edge and selectively mating the second angled edge to the fourth width edge.

8. The enclosure device of claim 1, further comprising a first pliant barrier tab disposed on a first side edge of the first barrier, the first pliant barrier tab having a first pliant barrier nub that is selectively insertable into a first slot in the first sloped panel, and a second pliant barrier tab disposed on a second side edge of the first barrier, the second pliant barrier tab having a second pliant barrier nub that is selectively insertable into a second slot in the second sloped panel.

9. The enclosure of claim 1, further comprising a lid that is complimentarily configured to the enclosure device and is slightly larger than the enclosure device, the lid having an open end and a closed end, the lid being selectively slidable over the enclosure device through the open end to close one of the first opening and the second opening.

10. The enclosure device of claim 1, further comprising a first side panel extension on the first side panel and a second side panel extension on the second side panel, each of the first side panel extension and the second side panel extension protruding past the first barrier when the first barrier is in the closed position.

11. An enclosure device for one or more of storage and transport of an art piece having a medium applied surface and an opposing back surface, the enclosure device comprising:

a flat base having a first length edge, a second length edge, a first width edge, and a second width edge;

a first side panel substantially perpendicularly disposed relative to the flat base and sharing the first length edge, the first side panel having a third length edge opposing the first length edge;

a second side panel substantially perpendicularly disposed relative to the flat base and sharing the second length edge, the second side panel having a fourth length edge opposing the second length edge;

a first sloped panel disposed at an angle relative to the flat base and sharing the third length edge, the first sloped panel having a fifth longitudinal edge opposing the third longitudinal edge, the first sloped panel being disposed at a first obtuse angle relative to the first side panel;

a second sloped panel disposed at an angle relative to the flat base and sharing the fourth length edge, the second sloped panel having a sixth longitudinal edge opposing the fourth longitudinal edge, the sixth longitudinal edge being selectively attachable to the fifth longitudinal edge, the second sloped panel being disposed at a second obtuse angle relative to the second side panel;

a first opening partially bordered the first width edge;

a second opening opposing the first opening and partially bordered the second width edge;

an art piece receiving space substantially disposed between the first side panel, the second side panel, and the flat base, the art piece receiving space configured to retain the art piece, the flat base configured to contact the back surface;

a canopy space substantially disposed between the first sloped panel and the second sloped panel, the canopy space configured to be disposed above the medium applied surface;

an apex ridge formed by attachment of the fifth longitudinal edge to the sixth longitudinal edge; and a first barrier attached to the first width edge, the first barrier being movable between an open position and a closed position to correspondingly open and close the first opening the first barrier being a pentagon-shaped barrier and the first opening being a pentagon-shaped opening when the fifth longitudinal edge is attached to the sixth longitudinal edge, wherein the canopy space is a triangular prism canopy space.

12. The enclosure device of claim 11, wherein the fifth longitudinal edge and the sixth longitudinal edge have one or more interlocking tabs and recesses for selectively mating the fifth longitudinal edge to the sixth longitudinal edge.

13. The enclosure device of claim 11, wherein the first sloped panel further comprises a third width edge and the second sloped panel further comprises a fourth width edge, the first barrier having a first angled edge that is selectively matable with the third width edge and a second angled edge that is selectively matable with the fourth width edge, and the first angled edge, the second angled edge, the third width edge, and the fourth width edge have one or more interlocking tabs and recesses for selectively mating the first angled edge to the third width edge and selectively mating the second angled edge to the fourth width edge.

14. The enclosure device of claim 11, further comprising a first pliant barrier tab disposed on a first side edge of the first barrier, the first pliant barrier tab having a first pliant barrier nub that is selectively insertable into a first slot in the first sloped panel, and a second pliant barrier tab disposed on a second side edge of the first barrier, the second pliant barrier tab having a second pliant barrier nub that is selectively insertable into a second slot in the second sloped panel.

15. The enclosure device of claim 11, further comprising a lid that is complimentarily configured to the enclosure device and is slightly larger than the enclosure device, the lid having an open end and a closed end, the lid being selectively slidable over the enclosure device through the open end to close one of the first opening and the second opening.

16. An enclosure device for one or more of storage and transport of an art piece, the enclosure device comprising:

a flat base;

a first side panel substantially perpendicularly disposed relative to the flat base and sharing a first length edge with the base;

a second side panel substantially perpendicularly disposed relative to the flat base and sharing a second length edge with the base, the second length edge opposing the first length edge;

a first sloped panel disposed at an angle relative to the flat base and sharing a third length edge with the first side panel, the third length edge opposing the first length edge;

a second sloped panel disposed at an angle relative to the flat base and sharing a fourth length edge with the second side panel, the fourth length edge opposing the second length edge, the first sloped panel and the second sloped panel sharing a fifth length edge, the fifth length edge opposing the third length edge and the fourth length edge;

an art piece receiving space substantially disposed between the first side panel, the second side panel, and the flat base, the art piece receiving space configured to retain the art piece;

a canopy space substantially disposed between the first sloped panel and the second sloped panel;

a first opening partially bordered by a first width edge of the base and a second opposing opening partially bordered by a second width edge of the base; and a first barrier operatively hinged to the first width edge, the first opening being a pentagon-shaped opening and the first barrier being a pentagon-shaped barrier.

17. The enclosure device of claim 16, further comprising a second barrier operatively hinged to the second width edge, the second opening being a pentagon-shaped opening and the second barrier being a pentagon-shaped barrier.

18. The enclosure device of claim 16, wherein the first sloped panel further comprises a third width edge and the second sloped panel further comprises a fourth width edge, the first barrier having a first angled edge that is selectively matable with the third width edge and a second angled edge that is selectively matable with the fourth width edge.

19. The enclosure device of claim 16, further comprising a first pliant barrier tab disposed on a first side edge of the first barrier, the first pliant barrier tab having a first pliant barrier nub that is selectively insertable into a first slot in the first sloped panel, and a second pliant barrier tab disposed on a second side edge of the first barrier, the second pliant barrier tab having a second pliant barrier nub that is selectively insertable into a second slot in the second sloped panel.

20. The enclosure device of claim 16, wherein the first sloped panel further comprises a third width edge and the second sloped panel further comprises a fourth width edge, the first barrier having a first angled edge and a second angled edge, the first angled edge, the second angled edge, the third width edge, and the fourth width edge having one or more interlocking tabs and recesses for selectively mating the first angled edge to the third width edge and selectively mating the second angled edge to the fourth width edge.

* * * * *